US008496805B2

(12) United States Patent
Sabottke et al.

(10) Patent No.: US 8,496,805 B2
(45) Date of Patent: Jul. 30, 2013

(54) DELAYED COKING PROCESS

(75) Inventors: Craig Y. Sabottke, Slidell, LA (US); Fritz A. Bernatz, Clifton, VA (US); Eric W. Fryatt, New Orleans, LA (US); Christopher P. Eppig, Saint Charles, IL (US); Jordan K. Lambert, New Orleans, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 459 days.

(21) Appl. No.: 12/828,876

(22) Filed: Jul. 1, 2010

(65) Prior Publication Data

US 2011/0005912 A1 Jan. 13, 2011

Related U.S. Application Data

(60) Provisional application No. 61/270,593, filed on Jul. 10, 2009.

(51) Int. Cl.
*C10G 9/14* (2006.01)

(52) U.S. Cl.
USPC ..... 208/131; 208/132; 201/4; 201/20; 201/28; 201/29; 201/30

(58) Field of Classification Search
USPC ..... 201/4, 20, 28–30; 208/131–132
See application file for complete search history.

(56) References Cited

U.S. PATENT DOCUMENTS

| | | | | |
|---|---|---|---|---|
| 4,009,094 | A | 2/1977 | Cole et al. | |
| 4,177,133 | A | 12/1979 | Hayashi et al. | |
| 4,213,846 | A | 7/1980 | Sooter et al. | |
| 4,216,074 | A | 8/1980 | Simone | |
| 4,455,219 | A | 6/1984 | Janssen et al. | |
| 4,458,759 | A * | 7/1984 | Isaacs et al. | 166/272.3 |
| 4,670,133 | A | 6/1987 | Heaney et al. | |
| 5,466,361 | A | 11/1995 | Heck et al. | |
| 5,711,870 | A | 1/1998 | Storm et al. | |

FOREIGN PATENT DOCUMENTS

EP 0250136 A2 12/1987

OTHER PUBLICATIONS

PCT/US2010/041290, PCT International Search Report, Form PCT/ISA/210, dated Dec. 28, 2010 4 pgs.

PCT/US2010/041290, PCT Written Opinion of the International Searching Authority, Form PCT/ISA/237, dated Dec. 28, 2010 5 pgs.

Siskin et al., "Chemical Approach to Control Morphology of Coke Produced in Delayed Coking", Energy & Fuels, vol. 20, pp. 2117-2124 (2006).

"Emissions From Delayed Cokers", Industry Professionals for Clean Air, pp. 2-5 (2009).

* cited by examiner

*Primary Examiner* — Brian McCaig

(74) *Attorney, Agent, or Firm* — Glenn T. Barrett; Malcolm D. Keen

(57) ABSTRACT

Petroleum cokes derived from extra-heavy crude sources can be made more amenable to quenching by adding water or a water/light oil mixture to the coker feed downstream of the furnace. The coke product resulting from this addition of normally volatile liquids to the hot coker feed is still relatively dense but is more friable and usually is in a compact, relatively free-flowing, granular form. The coke is more amenable to uniform quenching in the drum and so can be cut and discharged with a reduced risk of eruptions and a reduced risk of fires in the coke pit or when the coke is subsequently handled and transported.

7 Claims, 2 Drawing Sheets

DELAYED COKING PROCESS

CROSS-REFERENCE TO RELATED APPLICATIONS

This application relates to and claims priority to U.S. Provisional Patent Application No. 61/270,593, filed on Jul. 10, 2009.

This application is related to U.S. patent application Ser. No. 12/828,405, filed on Jul. 7, 2010, which is based upon U.S. Provisional Application No. 61/270,595, filed on Jul. 10, 2009 entitled "Delayed Coking Process", with F. A. Bernatz and M. Siskin as the named inventors. That application describes a delayed coking process using a feed derived from a very heavy oil such as one from the Orinoco Heavy Oil Belt; the invention described in that application makes use of a metal carbonate additive, preferably potassium carbonate, to reduce the density of the coke produced in the process.

FIELD OF THE INVENTION

The present invention relates to a delayed coking process and more particularly to a delayed coking process for making a coke which does not tend to inflame in the coke pit or during subsequent transport and handling.

BACKGROUND OF THE INVENTION

Delayed coking is one of several types of process used in oil refineries to convert heavy oils to useful lighter products. In delayed cokers, the heavy oil feed is heated in a continuously operating process furnace to effect a limited extent of thermal cracking, after which it enters a large, vertically-oriented cylindrical vessel or coking drum, in which the coking reactions take place. The term "delayed" coker refers to the fact that the coking reactions do not take place in the furnace, but rather are delayed until the oil enters the coke drum. In the coke drum, large oil molecules are further thermally cracked to form additional lighter products and residual coke, which fills the vessel. The lighter hydrocarbons flow out of the drum as vapor and are further processed into fuel products. Gradually the coke accumulates in the drum until it is almost filled with coke. When the drum is nearly filled, the hot oil from the furnace is directed to a clean coke drum, while the full one is decoked. The decoking cycle involves cooling and depressuring the drum, purging it with steam to remove residual hydrocarbon vapor, opening up the top and bottom heads (closures) on the drum and then using high pressure water lances or mechanical cutters to remove the coke from the drum. The coke falls out the bottom of the drum into a pit, where the water is drained off and conveyers take the coke to storage or rail cars. The drum is then closed up and is ready for another coking cycle.

The feedstocks for delayed cokers are typically the heaviest (highest boiling) fractions of crude oil that are separated in the crude fractionation unit, normally comprising an atmospheric distillation tower and vacuum tower. The nature of the coke formed is highly dependent on the characteristics of the feedstock to the coker as well as upon the operating conditions used in the coker. Although the resulting coke is generally thought of as a low value by-product, it may have some value, depending on its grade, as a fuel (fuel grade coke), electrodes for aluminum manufacture (anode grade coke). Generally, the delayed coker is considered to produce three types of coke that have different values, appearances and properties. Needle coke, sponge coke, and shot coke are the most common. Needle coke is the highest quality of the three varieties which commands a premium price; upon further thermal treatment, needle coke which has high electrical conductivity (and a low coefficient of thermal expansion) is used to make the electrodes in electric arc steel production. It is low in sulfur and metals and is frequently produced from some of the higher quality coker feedstocks that include more aromatic feedstocks such as slurry and decant oils from catalytic crackers and thermal cracking tars. Typically, it is not formed by coking of resid type feeds. Sponge coke, a lower quality coke, is most often formed in refineries from lower quality refinery coker feedstocks having significant amounts of asphaltenes, heteroatoms and metals. If the sulfur and metals content is low enough, sponge coke can be used for the manufacture of anodes for the aluminum industry. If the sulfur and metals content is too high for this purpose, the coke can be used as fuel. The name "sponge coke" comes from its porous, sponge-like appearance. Conventional delayed coking processes, using the vacuum resid feedstocks, will typically produce sponge coke, which is produced as an agglomerated mass that needs an extensive removal process including drilling and water-jet technology.

Shot coke is considered the lowest quality coke. The term "shot coke" comes from its spherical or ovoidal shape ball-like shape, typically in the range of about 1 to about 10 mm diameter. Shot coke, like the other types of coke, has a tendency to agglomerate, especially in admixture with sponge coke, into larger masses, sometimes larger than a foot in diameter. This can cause refinery equipment and processing problems. Shot coke is usually made from the lowest quality high resin-asphaltene feeds and makes a good high sulfur fuel source, particularly for use in cement kilns and steel manufacture. There is also another coke, which is referred to as "transition coke" and refers to a coke having a morphology between that of sponge coke and shot coke. For example, coke that has a mostly sponge-like physical appearance, but with evidence of small shot spheres beginning to form as discrete shapes. The term "transition coke" can also refer to mixtures of shot coke bonded together with sponge coke.

Another type of coke sometimes encountered is generally referred to as "dense coke" by reason of its high density. It results from using very low gravity (heavy) feeds such as those from tar sands and heavy oil crudes such as those from the Orinoco Heavy Oil Belt in Venezuela. These dense cokes are difficult to process: they are hard to cut out of the drum and do not readily form particles which can easily be handled—frequently they form large, heavy, boulder-like lumps. A particular problem is that their density does not make them amenable to quenching in the manner of shot coke or even sponge coke. The surface area of sponge coke makes it possible for the coke to take up water during the quench phase of the cycle so that it cools off relatively uniformly; conversely, the small size of the shot coke particles makes it possible, in principle at least, to quench this product in an acceptably short period of time. If, however, the process has resulted in a combination of coke morphologies in the drum with more than one type of coke product present, the quenching may be non-uniform and eruptions and discharges may occur when the drilling is commenced or the coke discharged through the bottom header. The dense cokes produced from the very heavy oils are particularly troublesome in this respect since their heavy, dense, non-porous nature tends to prevent the quench water from penetrating the coke mass well so that the problems resulting from slow quenching tend to be more frequently encountered, particularly as more and more heavy crude oils are refined to meet demand for fuel products. Unquenched coke presents a particular hazard since it may result in spontaneous coke pit fires and, when loaded onto barges, coke barge fires. This problem is exacerbated by the fact that the heavy oils feeds from the dense cokes produce larger proportions of coke than many other feeds, so aggravating both the extent and severity of the problem.

Since a quenchable coke will cool more evenly than dense, low porous coke morphologies it would be desirable to have the capability to produce a coke product from the heavy oils that can be cooled and quenched in the delayed coker drum, in order to avoid or minimize hot drums and coke fires.

SUMMARY OF THE INVENTION

We have now found that petroleum cokes derived from extra-heavy crude sources can be made more amenable to quenching by adding water or a water/light oil mixture to the coker feed after the furnace. The coke product resulting from this addition of normally volatile liquids to the hot coker feed results in a coke which is still relatively dense but which is more friable and usually is in compact, granular form. The coke is more amenable to uniform quenching in the drum and so can be cut and discharged with a reduced risk of eruptions and a reduced risk of fires in the coke pit or when the coke is subsequently handled and transported.

According to the present invention, the delayed coking process for producing a coke of improved quenchability from very heavy oil feed comprises: heating a petroleum resid feed derived from a heavy crude having a gravity of 5 to 20° API, to a coking temperature up to 520° C.; injecting a volatile liquid comprising water into the heated resid; coking the resid in a delayed coking drum from which coking vapor products are collected and a coke product is formed as a mass in the drum; quenching the coke mass in the drum to producing a solid coke product.

The normal sequence of steps in this process will be as follows: the resid feed from the heavy crude is heated in a first heating zone, to a temperature at which it is a pumpable liquid; the resid is then passed to a furnace where it is heated further to a temperature suitable for delayed coking, up to 520° C.; the heated resid is conducted from the furnace to a delayed coking drum in a transfer line; a volatile liquid comprising water is injected into the heated resid in the transfer line; the heated resid is coked in the coking drum with the vapor products produced in the coking being removed as overhead to form a quenchable coke product as a mass in the drum, the coke mass is quenched in the drum; the quenched coke is cut and then removed as a quenched, solid product from the drum.

DRAWINGS

DETAILED DESCRIPTION

Figure 1:
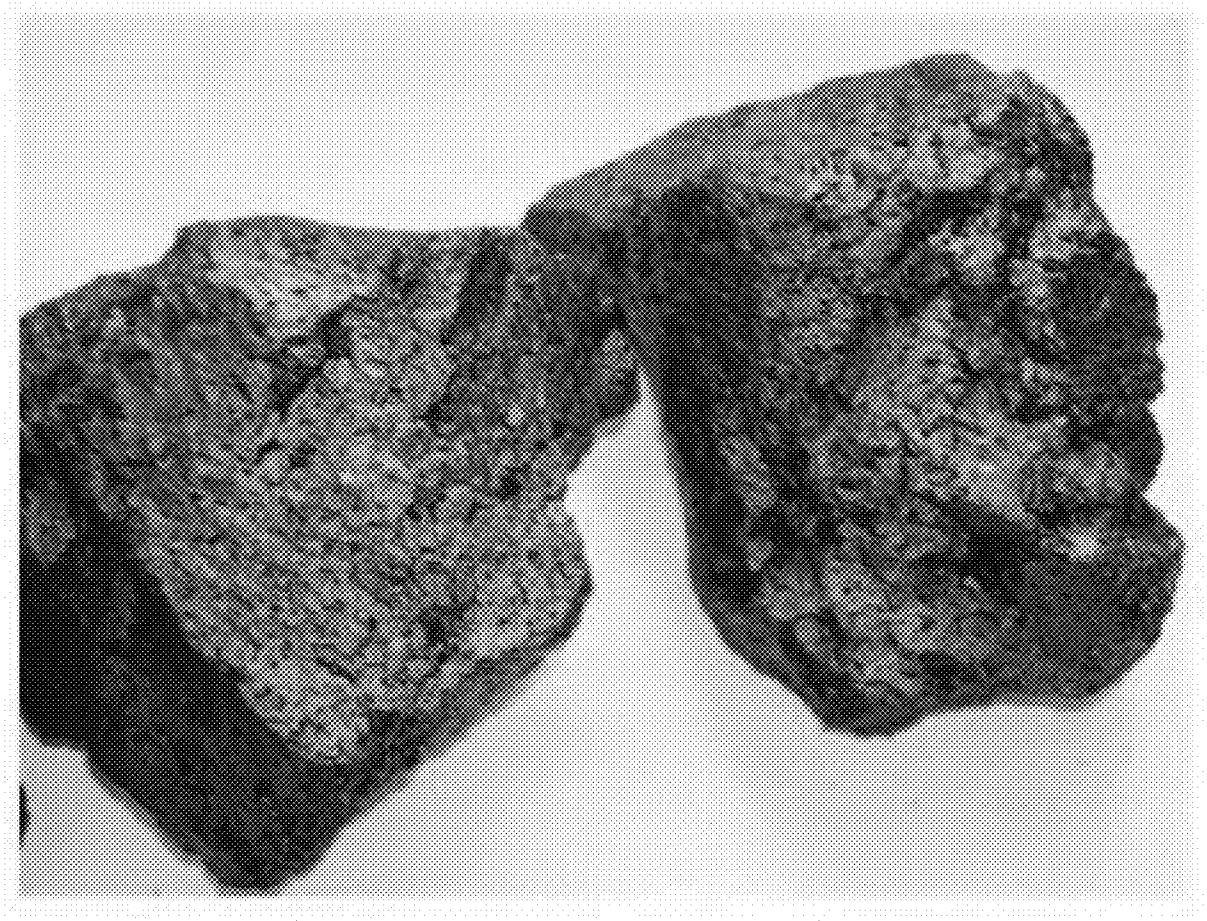
FIG. 1 is an optical image of the dense coke produced from processing a vacuum resid derived from a synthetic crude from the Morichal sand reservoirs in a delayed coker unit.

The present invention is directed to dealing with the problems which are encountered in the delayed coking of heavy oil feeds which are produced from extra heavy crude sources. Crude sources of this type are being increasingly used in fuels production as the supplies of lighter, easier-to-process crudes are becoming either shorter, more costly or are being used for more valuable purposes. Crude sources of this kind include tar sands such as the tar sands, tar pits and pitch lakes of Canada (Athabasca, Alta.), Trinidad, Southern California (La Brea (Los Angeles), McKittrick (Bakersfield, Calif.), Carpinteria (Santa Barbara County, Calif.), Lake Bermudez (Venezuela) and similar deposits in Texas, Peru, Iran, Russia and Poland. Of these, the most significant commercially at the present time is the tar sand belt in Venezuela, especially the Orinoco Tar Belt and the Cerro Negro part of the Belt. The crudes from these oilfields are generally characterized by a low API gravity (low hydrogen content), typically in the range of 5-20° API and in many cases from 6 to 15° with some ranging from 8 to 12° API. Examples include the 8.5° API Cerro Negro Bitumen and crudes from the Morichal (8-8.5° API), Jobo (8-9° API), Pilon (13° API) and Temblador (19° API) oilfields. These extra-heavy oils are normally produced by conventional enhanced recovery methods including alternated steam soaking. The heaviest types of these oils such as the Morichal and Jobo crudes are normally diluted at the well-head with gasoil or lighter crudes or processed petroleum fractions such as heavy naphthas, distillates or thermal cracking products including coker gas oils and coker naphthas, in order to reduce their high viscosity and facilitate their transport by pipeline and to attain their sale specification as synthetic crudes, for instance, as the commercial blend known as the Morichal Segregatio (12.5° API) or the blend of Pilon and Temblador sold as Pilon Segregation (13.5° API) or the Pilon blend in which all the crudes produced from the region are diluted to 17° API with lighter crudes from the adjacent San Tome area. Fractions which can be used as diluents may themselves be produced by thermal cracking processes such as visbreaking, delayed coking.

These crudes may be processed by conventional refining techniques into the desired higher value hydrocarbon products. Normally processing, which be carried out on the diluted synthetic crude stocks, will include desalting followed by atmospheric and vacuum distillation to remove light ends including the diluents, to leave a high boiling resid fraction which can then be further processed to produce more light products. Delayed coking and fluid coking are particularly apt for converting these residual fractions since their high CCR will normally deposit excessive coke in catalytic cracking operations unless specifically designed for resid cracking. When heavy oil feeds derived from these crude sources are subjected to delayed coking in commercial size units (typically in drums over 8 m in diameter above the bottom conical section), a large volume of very dense, hard, non-porous coke results under normal coking conditions, e.g. with moderate pressures over about 100 or 150 kPag (15 or 22 psig) and temperatures of about 400-500° C. (750 to 930° F.), e.g. 415° C. (780° F.) in the drum. The coke density of the mass in the drum is typically over 1,000 kg/m$^3$ (62 lb/ft$^3$) and usually in the range of 1040-1120 kg/m$^3$ (65-70 lb/ft$^3$) compared with typical delayed coker coke densities of 830-930 kg/m$^3$ (52-58 lb/ft$^3$) for both sponge coke and shot coke. As noted above, the dense, hard masses that these cokes from are difficult to quench adequately and to remove from the drum and even when removed, present a continuing fire hazard until a long cooling period has elapsed. The problem is particularly notable when processing residual feeds derived from the lowest API crudes, especially those with an API density below 10° and most notably with feeds derived form crudes of 9° API or less such as feeds from the Morichal and Cerro Negro crude sources, both in the range of 8-8.5° API.

The delayed coker feeds from the very heavy crude sources will be residual types feeds, that is, with a minimal content of components boiling below about 500° C.; generally the feed will have an initial boiling point in the range of 525-550° C.

(975-1025° F.) or higher, an API gravity of about 20° or less and a Conradson Carbon Residue content of about 20 to 40 weight percent. In most cases, the coker feed will be a vacuum resid produced from one the very heavy crude sources by the normal process including desalting, atmospheric distillation, vacuum distillation.

The feed will typically be subjected to delayed coking by heating it to a temperature from about 480° C. to about 520° C. (895 to 970° F.) in a fired heater, usually a tubular furnace, after which it is discharged to the coking drum through a transfer line, entering the drum through a an inlet in the base of the drum. Pressure in the furnace is typically about 350 to 3500 kPag (about 50 to 550 psig) but pressure in the drum is usually relatively low, typically from about 100 to 550 kPag (about 15 to 80 psig) to allow volatiles to be removed overhead. Typical operating temperatures in the drum will be between about 420° and 475° C. (790 and 890° F.). The hot feedstock continues to thermally crack over a period of time (the "coking time") in the coker drum, liberating volatiles composed primarily of volatile hydrocarbon products that continuously rise through the coke mass and are collected overhead. The volatile products are sent to a coker fractionator for distillation and recovery of coker gases, gasoline, distillate, light gas oil, and heavy gas oil fractions. A portion of the heavy coker gas oil present in the product stream can be captured from the fractionator for recycle and combined with the fresh feed (coker feed component), thereby forming the coker heater or coker furnace charge. In most cases, the fresh heavy oil feed is introduced into the coker unit through the coker fractionator, also referred to as the combination tower from its function to fractionate the products from the drum as well as stripping light ends remaining in the feed. The fresh feed normally enters the tower at a level above that of the drum vapors to provide for direct heat exchange between the coking vapors and the incoming feed. Low drum pressures and low recycle volumes are preferred for optimal operation with the heavy feeds: pressures below about 150 kPag (about 22 psig) are preferred although may existing units will be run at pressures in the range of 150 to 350 kPag (about 22 to 50 psig). Recycle ratios (recycle:fresh feed) of from 1:20 to 1:4 will normally be suitable.

The quenchability of the coke produced from these heavy feeds is enhanced by injecting water alone or with a light oil into the coker feed after it has passed through the heater. The water or water/oil can therefore be added at the heater coil outlet, in the transfer line between the heater and the drum or directly into the drum itself or in multiple locations. So, broadly stated, the temperature of the feed at the injection location will typically be from about 480-520° C. (895-970° F.). This will be hot enough to vaporize the water and light oil but complete vaporization will not normally take place in the transfer line since the flow rate in the transfer line will normally ensure a short residence time in the transfer line so that heat transfer to the injected droplets and the resulting vaporization will be incomplete by the time that the feed/water/light oil mixture enters the drum.

The water may be injected by itself into the heated feed or emulsified or dispersed into a light oil acting as a hydrocarbon carrier to facilitate uniform mixing of the water into the heavy oil coker feed. Minor quantities of a surfactant may be added to promote mixing of the aqueous solution into hydrocarbon carriers such as naphtha or kerosene fractions. Alternatively, the water and light oil may be mixed with a mutual solvent such as an alcohol either as such or also with the light oil.

The use of water alone is sufficient to produce a perceptible improvement in the quenchability of the dense coke but the water may be added with an additional quantity of a light oil in order to promote more uniform dispersion into the rather viscous heavy oil feed. Light oils which may be used may be naphthas or distillates. Napthas may be light or heavy naphthas and will typically have an end point below 200° C. and in most cases below 150° C. (300° F.); the distillates which may be used will typically have an initial boiling point above the refinery naphtha and an end point below 400 or 500° C. (750 or 930° F.), in most cases below 350° C. (660° F.).

The total amount of water or water plus oil injected into the feed is typically about 0.5-5 v/v percent, based on the volume of the feed, in most cases, 0.5 to 2 v/v percent, For economic reasons, it will normally be preferred to limit the relative amount of light oil to the water, relying on the water to effect the desired improvement in quenchability although the presence of the light oil is preferred in order to improve the uniformity of the final coke product. The amount of oil relative to the water in the injected liquid will normally be from 10-50 v/v percent with the upper limit on the oil selected mainly on economic considerations; amounts in the range 20-50 v/v percent will typically be adequate to promote a uniform structure and quenchability in the final coke product.

Figure 2:
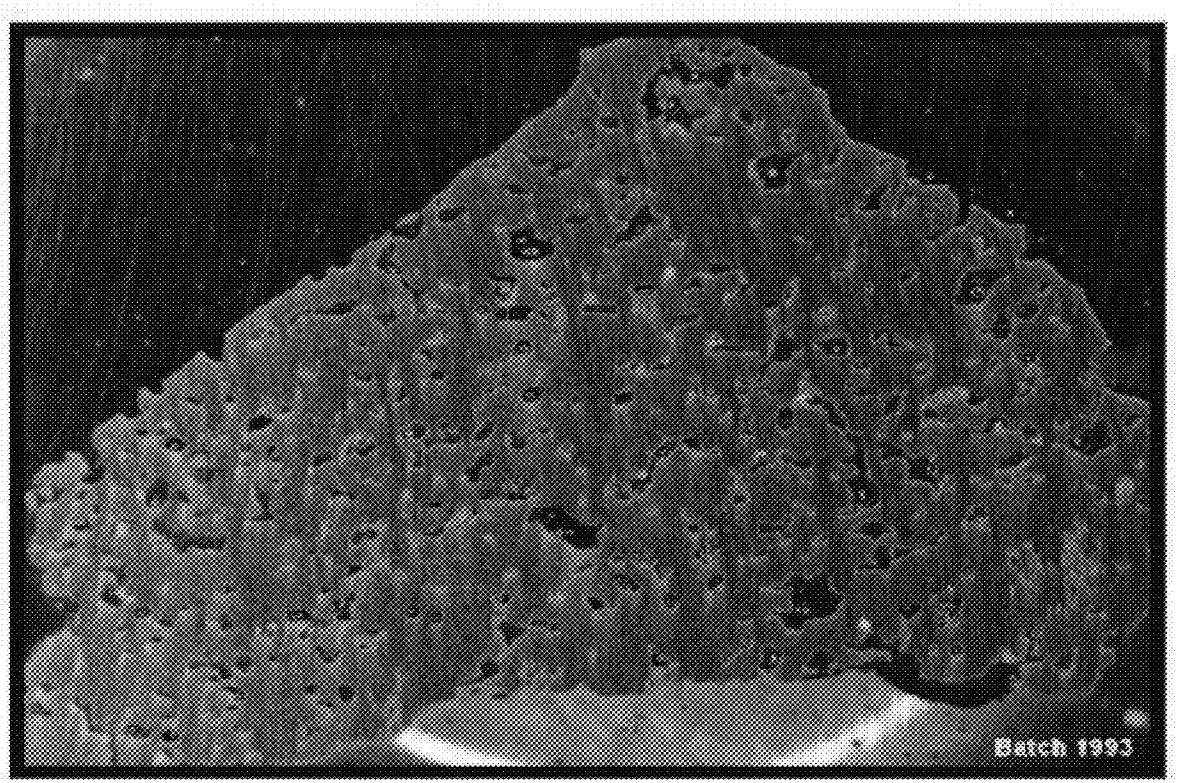
FIG. 2 is an optical micrograph of a dense non-porous coke produced from a vacuum resid derived from a synthetic crude from the Morichal sand reservoirs with no additive.

FIG. 1 shows the gross form of the conventional dense coke product—large lumps that in some cases, can be as large as boulders when cut from the drum. FIGS. 2 and 3 show micrographs of dense cokes. For a comparison between the dense coke structures shown in of FIG. 2 and conventional shot coke and sponge coke, refer to the article by Siskin et al, Chemical Approach to Control Morphology of Coke Produced in Delayed Coking, Energy & Fuels, 2006, 2117-2124. The shot cokes shown in FIGS. 3 and 4B of the article show a relatively uniform, fine pattern of small voids in a mosaic structure with small anisotropic flow domains (2-10 μm, 2-3 μm respectively) and the sponge coke of FIG. 4A has larger interstices and flow domains in the 10-50 μm size range. The dense coke of FIG. 2 has a structure in which the voids are small and not highly numerous. By contrast, the coke produced with the addition of water or water and light oil is granular and may be almost friable. It breaks up more easily when quenched and cut in the drum and forms a product which can easily be handled and transported. Its density is usually comparable to that of the coke produced without the water or water/oil addition, even though the product is essentially free-flowing and can be readily removed from the drum after cutting. The density retention is advantageous in that the denser coke will occupy less volume in the drum, so permitting a greater volume of feed to be processed in each operational cycle. Importantly, the coke can be effectively quenched in the drum within an acceptable time span, that is, in a time comparable to that needed by a sponge coke in the same drum. This, in turn makes it possible to discharge the coke with a greater assurance that coke pit fires will not ensue and that the coke will not subsequently inflame.

The water or water oil combination can be injected into the resid flow through the use of a refractory lined quill or by other suitable techniques. A coke drum bottom inlet injector can, for example, be installed to produce an unobstructed jet within the coke drum. High energy mixing or use of static mixing devices in the transfer line or upstream of the heater may be employed to assist in dispersal of the additive fluid but normally will be found more troublesome than a simple feed quill after the heater. Uniform dispersal of the liquid into the resid feed is desirable to avoid heterogeneous areas of coke morphology formation: locations in the coke drum where the coke is substantially free flowing and other areas where the coke is substantially non-free flowing are not wanted.

When the water or water oil combination is introduced into the feed in the transfer line between the furnace and the drum, the injection nozzle or quill should preferably be configured to deliver the liquid to the center line flow of the pipe/transfer line. In view of the high temperatures prevailing in the transfer line, the injection nozzle or injection quill is preferably provided with an insulating thermal sleeve to prevent premature heat transfer to the injected liquid with consequent vaporization of the solution within the nozzle before entering the feed stream.

The coke which is produced by the use of the carbonate additive with the heavy crude origin feeds is notably different in its characteristics from the coke that is produced by delayed coking in the absence of the additive. FIG. 1 shows the gross form of the conventional dense coke product—large lumps that in some cases, can be as large as boulders when cut from the drum. FIGS. 2 and 3 show micrographs of dense cokes. For a comparison between the dense coke structures shown in of FIG. 2 and conventional shot coke and sponge coke, refer to the article by Siskin et al, *Chemical Approach to Control Morphology of Coke Produced in Delayed Coking*, Energy & Fuels, 2006, 2117-2124. The shot cokes shown in FIGS. 3 and 4B of the article show a relatively uniform, fine pattern of small voids in a mosaic structure with small anisotropic flow domains (2-10 μm, 2-3 μm respectively) and the sponge coke of FIG. 4A has larger interstices and flow domains in the 10-50 μm size range. The dense coke of FIG. 2 has a structure in which the voids are small and not highly numerous. By contrast, the coke produced with the addition of water or water and light oil is granular and may be almost friable. It breaks up more easily when quenched and cut in the drum and forms a product which can easily be handled and transported. Its density is usually comparable to that of the coke produced without the water or water/oil addition, even though the product is essentially free-flowing and can be readily removed from the drum after cutting. The density retention is advantageous in that the denser coke will occupy less volume in the drum, so permitting a greater volume of feed to be processed in each operational cycle. Importantly, the coke can be effectively quenched in the drum within an acceptable time span, that is, in a time comparable to that needed by a sponge coke in the same drum. This, in turn makes it possible to discharge the coke with a greater assurance that coke pit fires will not ensue and that the coke will not subsequently inflame.

EXAMPLE 1

An Orinoco Heavy Oil belt derived resid was processed by delayed coking using an 8 m (26 ft) diameter commercial coke drum with a pre-heating zone temperature of 285-295° C., a furnace outlet temperature of 486° C. and a coking drum temperature of 400-415° C. Using the heavy oil feed without liquid injection in the transfer line, a fairly dense coke with observed jagged edges was produced. The coke density was 1,041 kg/m$^3$ and the volume of coke produced relative to the volume of resid feed was measured at 0.31 m$^3$ coke/m$^3$ feed (1.94 ft$^3$ coke/bbl feed). The coke was quite non-porous when observed at 60× magnification as shown in FIG. 2.

The results are summarized in Table 1 below.

EXAMPLES 2-3

The Orinoco resid was subjected to delayed coking with equal volumes of water and 38 API naphtha (1.3 vol. percent total relative to feed) added to the feed in the transfer line after the furnace. This resulted in a unique and unexpected granular coke that was mechanically softer than the dense coke of Example 1 although the coke density remained at 1,041 kg/m$^3$. The coke volume relative to feed was 0.30-0.32 m$^3$ coke/m$^3$ feed (2.2 ft$^3$ coke/bbl feed).

The results are summarized in Table 1 below.

TABLE 1

| Ex. No. | Feed Rate, m$^3$/hr. | Water, 1/hr. | Naphtha, 1/hr. | Coke density, kg/m$^3$ | ΔT, ° C. (Coil Outlet-Drum Inlet) | Coke vol/ Feed vol., m$^3$/m$^3$ |
|---|---|---|---|---|---|---|
| 1 | 141 | | | 1041 | 15 | 0.31 |
| 2 | 150 | 1000 | 1000 | 1041 | 21 | 0.30 |
| 3 | 155 | 1000 | 1000 | 1041 | 21 | 0.32 |

The invention claimed is:

1. A delayed coking method comprising:

(a) heating a petroleum resid feed derived from a heavy crude having a gravity of 5 to 9° API in a first heating zone, to a temperature at which the resid is a pumpable liquid;

(b) heating the resid further in a furnace to a coking temperature of up to 520° C.;

(c) conducting the heated resid from the furnace in a transfer line to a delayed coking drum;

(d) injecting a volatile liquid comprising water and a naphtha having an end point up to 150° C. into the heated resid in the transfer line in an amount from 0.5 to 2 v/v percent volatile liquid to feed;

(e) subjecting the heated resid in the coking drum to coking at a coking temperature up to 520° C. and at 100 to 550 kPag coking drum pressure and removing the vapor products produced in the coking as overhead and forming a quenchable coke product as a mass in the drum (f) quenching the coke mass in the drum to produce a solid coke product;

(g) removing the quenched coke product from the drum.

2. A process according to claim 1 in which the resid feed comprises an atmospheric or vacuum resid derived from an Orinoco Heavy Oil crude.

3. A process according to claim 2 in which the temperature of the drum is from 400 to 500° C.

4. A process according to claim 2 in which the resid feed comprises an atmospheric vacuum resid derived from an Orinoco Heavy Oil crude.

5. A process according to claim 2 in which the amount of the volatile liquid injected into the heated feed is about 1.3 v/v percent volatile liquid to feed.

6. A process according to claim 1 in which the volatile liquid comprises water and a light hydrocarbon oil having an end point up to 400° C.

7. A process according to claim 1 in which the amount of naphtha relative to water in the volatile liquid is from 10 to 50 percent v/v of the liquid.

* * * * *